United States Patent [19]

Schwab

[11] 4,102,600

[45] Jul. 25, 1978

[54] MOVING BLADE RING OF HIGH CIRCUMFERENTIAL SPEED FOR THERMAL AXIALLY PASSED THROUGH TURBINES

[75] Inventor: Günter Schwab, Nuremberg, Fed. Rep. of Germany

[73] Assignee: Maschinenfabrik Augsburg-Nurnberg Aktiengesellschaft, Nüremberg, Fed. Rep. of Germany

[21] Appl. No.: 674,752

[22] Filed: Apr. 8, 1976

[30] Foreign Application Priority Data

Apr. 9, 1975 [DE] Fed. Rep. of Germany ..... 2515444

[51] Int. Cl.[2] ..... F01D 5/14

[52] U.S. Cl. ..... 416/91; 416/231 R

[58] Field of Search ..... 416/231, 231 B, 91, 416/183, 200 A, 200, 198 A; 415/DIG. 1

[56] References Cited

U.S. PATENT DOCUMENTS

| | | | |
|---|---|---|---|
| 634,885 | 10/1899 | Glover | 416/231 B |
| 1,744,709 | 1/1930 | Moody | 416/183 X |
| 2,045,383 | 6/1936 | Faber | 416/231 B |
| 3,044,559 | 7/1962 | Chajmik | 416/231 X |
| 3,442,441 | 5/1969 | Dettmering | 415/DIG. 1 |
| 3,692,425 | 9/1972 | Erwin | 415/DIG. 1 X |

FOREIGN PATENT DOCUMENTS

| | | | |
|---|---|---|---|
| 453,894 | 6/1913 | France | 416/231 B |
| 530,413 | 12/1921 | France | 416/231 B |
| 390,486 | 2/1924 | Fed. Rep. of Germany | 416/231 B |
| 459,204 | 4/1928 | Fed. Rep. of Germany | 416/91 |
| 1,053,713 | 3/1959 | Fed. Rep. of Germany | 416/91 |
| 39,656 | 12/1936 | Netherlands | 416/231 B |
| 15,835 of | 1909 | United Kingdom | 416/231 B |
| 736,835 | 9/1955 | United Kingdom | 416/231 B |

*Primary Examiner*—Everette A. Powell, Jr.
*Attorney, Agent, or Firm*—Walter Becker

[57] ABSTRACT

A blade ring of high circumferential speed for thermal axially passed through turbines, especially for the last stage of condensing steam turbines, having at least the radially outer portion of its blades lying within the range of transsonic flow or within the range of supersonic flow. Each blade of the blade ring changes from the profile at the foot portion of the blade toward the tip of the blade into a profile defined to a major extent by straight lines or by only slightly curved lines. This profile is about one half of its length at its upper region provided with a slot along the longitudinal axis of the blade. This profile which thus has two sections has one of these sections with its exit edge turned relative to the other section by an angle corresponding to the post-expansion of the supersonic flow into such a direction that the profile part with the exit edge lies in the flow-off direction.

2 Claims, 4 Drawing Figures

MOVING BLADE RING OF HIGH CIRCUMFERENTIAL SPEED FOR THERMAL AXIALLY PASSED THROUGH TURBINES

The present invention relates to a moving blade ring of high circumferential speed for thermal axially passed through turbines, especially for the last stage of condensation steam turbines, in which at least the radial outer portion of the blades is located in the region of the transsonic flow or supersonic flow.

The construction of condensation steam turbines of high output requires low pressure parts with as large as possible exit surfaces which necessitates relatively long blades at the end stages. With the largest built turbines, circumferential speeds of 600 m/s and above are obtained at the blade tips while the sound velocity of the steam amounts to about 300 m/s. In the radial outer part of the cascade, the relative flow is, as a rule, transsonic which means that the steam enters the cascade at a speed which is below the speed of sound and leaves the cascade at supersonic speed which may be a Mach number of about 1.7 and higher.

As long as the flow velocity amounts to slightly more than the Mach number 1, the conventional profiles of the airfoils as shown in FIG. 1 will suffice. With increasing unit output of the turbosets at the above mentioned high circumferential speed and steam velocity, the profiles with their ever decreasing thickness could no longer be satisfactory, because the profile losses greatly increased and the intended high Mach number could not be reached, at the exit while due to the jet deflection at the blade exit, the degree of efficiency of the stages would drop.

It is, therefore, an object of the present invention to provide a moving blade ring of the above described general character which will also at high Mach numbers still have a high degree of efficiency.

This object and other objects and advantages of the invention will appear more clearly from the following specification in connection with the accompanying drawing, in which.

Figure 1:
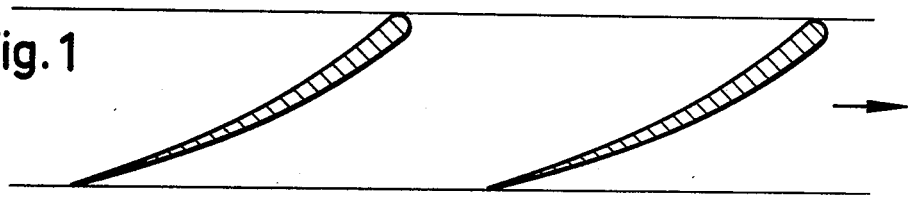
Prior Art Fig. 1
FIG. 1 illustrates the heretofore customary profile of the airfoils.
Figure 2:
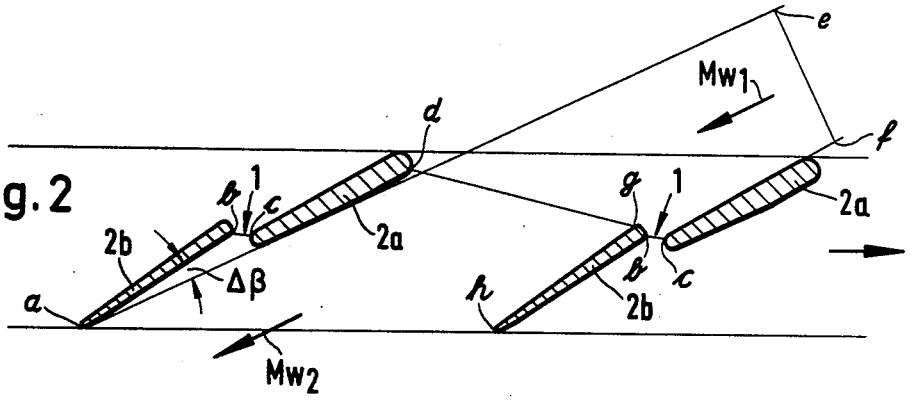
FIG. 2 represents a section of a development of a cylindrical surface which is coaxial with regard to the rotor shaft, the cylindrical surface intersecting the blades in the upper range.
Figure 3:
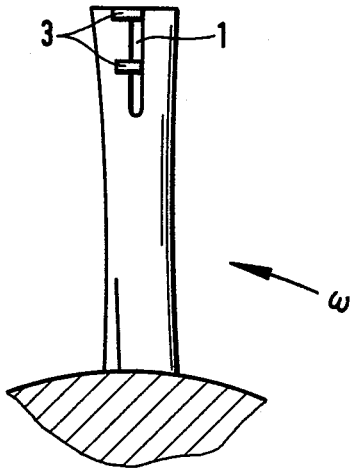
FIG. 3 is a cutout of the wheel disc when viewing in the direction of the flow with one of the moving blades.
Figure 4:
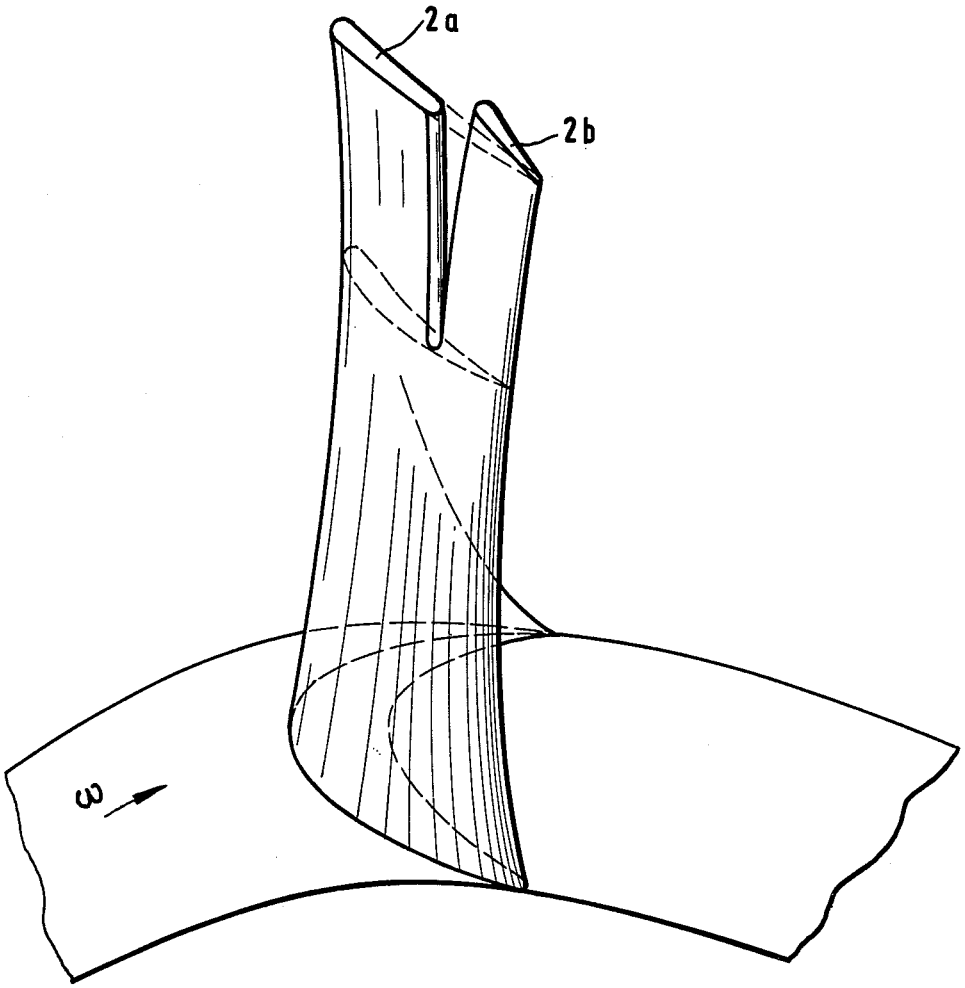
FIG. 4 is a perspective view of one blade of FIG. 3.

The moving blade ring according to the present invention is characterized primarily in that each blade extending from the profile at the foot toward the tip and changing into a primarily straight or slightly curved profile, at approximately half the length of the profile is in the upper range at its longitudinal axis provided with a slot, and is furthermore characterized in that the profile part with its exit edge is turned relative to the other profile in such a direction that the profile part has its exit edge located in the flow off direction; the angle by which this profile part is turned corresponds to the post-expansion of the supersonic flow.

The above outlined features bring about that the profile losses and the flow-off angle are relatively small whereby the desired high degree of efficiency is made possible.

According to a further advantageous development of the invention, the slot width is bridged by one or more spacer members. In comparison to a non-slotted profile, the design according to the present invention together with the twist brings about an increase in the moment of resistance of the moving blade or rotor blade.

Referring now to the drawings in detail, the moving blades for the end stage especially of condensing reheat turbines of great power have at their foot and central sections a profile which is customary for such turbines. The outer portion of each blade located in the region of slight flow deflection is provided with a slot 1 at its longitudinal axis. The slot is so located that two profile parts 2*a* and 2*b* are formed which have about the same length of chord. The two profile parts 2*a* and 2*b* are to the major extent formed by a straight line.

The profile part with the exit edge 2*b* is relative to the profile part 2*a* turned about the angle $\Delta\beta$ which angle corresponds to the post-expansion of the supersonic flow. This angle is such that the profile part 2*b* is located in the flow-off direction.

For purposes of increasing the moment of resistance of the moving blades, there are provided spacer members 3 which bridge the slot 1.

With small angles of attack the value $t/1 = 1.1$ ($t$ standing for the cascade division -Gitterteilung- and 1 standing for the length of chord) should not be exceeded.

The flow technical features of the cascade according to the invention are as follows:

1. In the region *d-g-h-a-b-c-d* the confining walls are divergent, i.e. supersonic flow exists in the entire region.

2. The length or distance *e–f* of the incident flow is less than the distance *d-g-b-c*, which means that also in the field *d-g-b-e-f-e* a supersonic flow may exist whereby the cascade will be best suited for a supersonic flow or a transsonic flow, and 3. the profile part 2*b* is located in flow direction.

With the design according to the present invention the expansion of the flow medium is in a controlled manner effected between the walls in such a way that the degree of efficiency is particularly high.

The onflow Mach number $Mw_1$ lies expediently betwen 0.8 and 1.2; the flow-off Mach number $Mw_2$ lies between 1.5 and 2.0.

The contours of the profile parts 2*a*, 2*b* may also be slightly curved.

It is, of course, to be understood that the present invention is, by no means, limited to the specific showing in the drawing but also comprises any modifications within the scope of the appended claims.

What is claimed is:

1. A blade ring combination of high circumferential speed for thermal axially passed through turbines and having blades each with a radially outer portion and a profile at a foot portion of a profile length extending from an upper region to the foot portion defining an exit edge along a side thereof, especially for the last stage of condensing steam turbines, with at least the radially outer portion of the blades of said blade ring lying within the range of transonic flow or within the range of supersonic flow, in which each blade of said blade ring changes from the profile at the foot portion of the blade toward the blade tip into a profile part defined to a major extent by at least nearly straight lines, the profile part of each of said blades at about one half of the profile length at the upper region thereof being provided with a slot located along its longitudinal axis and dividing each blade into two sections one of which with the exit edge being turned relative to the other section by an angle corresponding to the post-expansion of the supersonic flow in such a direction that the profile part is turned about an angle so that the exit edge thereof lies in the flow-off direction to provide good efficiency of high Mach figures.

2. A blade ring in combination according to claim 1, which includes at least one spacer member bridging the width of a slot.

* * * * *